US006543406B1

(12) United States Patent
Pohjola

(10) Patent No.: US 6,543,406 B1
(45) Date of Patent: Apr. 8, 2003

(54) ROTARY PISTON COMBUSTION ENGINE

(76) Inventor: Jukka Kalevi Pohjola, Steniuksentie 43 A 3, FIN-00320 Helsinki (FI)

( * ) Notice: Subject to any disclaimer, the term of this patent is extended or adjusted under 35 U.S.C. 154(b) by 0 days.

(21) Appl. No.: 09/857,649

(22) PCT Filed: Jan. 12, 1999

(86) PCT No.: PCT/FI99/00994

§ 371 (c)(1),
(2), (4) Date: Jun. 7, 2001

(87) PCT Pub. No.: WO00/34635

PCT Pub. Date: Jun. 15, 2000

(30) Foreign Application Priority Data

Dec. 7, 1998 (FI) ..... 982637

(51) Int. Cl.[7] ..... F02B 53/04

(52) U.S. Cl. ..... 123/228; 123/238; 123/232; 123/235

(58) Field of Search ..... 123/228, 229, 123/206, 222, 232, 238, 235; 418/191, 196

(56) References Cited

U.S. PATENT DOCUMENTS

| | | | | | |
|---|---|---|---|---|---|
| 892,201 | A | * | 6/1908 | Welsh et al. | 123/228 |
| 896,485 | A | * | 8/1908 | Tinlin | 123/232 |
| 1,226,745 | A | * | 5/1917 | Brooks | 123/232 |
| 1,311,858 | A | * | 7/1919 | Fischer | 123/238 |
| 1,406,140 | A | | 2/1922 | Anderson | 418/118 |
| 1,637,958 | A | | 8/1927 | Newson | 123/229 |
| 2,070,631 | A | | 2/1937 | Sunderland | 123/229 |
| 2,198,130 | A | * | 4/1940 | Schweiger | 123/232 |
| 2,412,949 | A | | 12/1946 | Brown et al. | 123/206 |
| 2,571,642 | A | * | 10/1951 | Yancy | 123/232 |
| 2,722,201 | A | * | 11/1955 | Muse | 123/232 |
| 2,977,939 | A | * | 4/1961 | Fearing | 123/228 |
| 3,692,002 | A | | 9/1972 | Williams | |
| 3,699,930 | A | * | 10/1972 | Bunce | 123/235 |
| 3,739,754 | A | | 6/1973 | Nutku | 123/229 |
| 3,745,979 | A | | 7/1973 | Williams | 123/8.15 |
| 3,913,532 | A | * | 10/1975 | Frentzel et al. | 123/232 |
| 3,935,840 | A | * | 2/1976 | Fisher | 123/238 |
| 4,086,881 | A | | 5/1978 | Rutten | 123/228 |
| 4,423,710 | A | * | 1/1984 | Williams | 123/228 |
| 6,132,197 | A | * | 10/2000 | Adamovski et al. | 123/229 |
| 6,250,277 | B1 | * | 6/2001 | Adamovski et al. | 123/238 |
| 6,298,821 | B1 | * | 10/2001 | Bolonkin | 123/228 |

FOREIGN PATENT DOCUMENTS

| | | |
|---|---|---|
| GB | 2212216 | 7/1989 |

* cited by examiner

*Primary Examiner*—Thomas Denion
*Assistant Examiner*—Thai-Ba Trieu
(74) *Attorney, Agent, or Firm*—Gifford, Krass, Groh, Sprinkle, Anderson & Citkowski, P.C.

(57) ABSTRACT

The invention relates to a 4-phase rotary piston combustion engine. The embodiment of the engine consists of the engine body (1) where the main cylinder (2) is located; the piston (4) which revolves in the main cylinder and a cylindrical piston body is a fixed shaft (5). Thus the shaft functions as the driving shaft of the engine. The engine is operated by two valves (6, 9) which either open or close the space existing between the main cylinder surface and the piston body. The rotation of the piston is achieved when the gas mixture compressed into explosion volume is closed in between both the valves (6, 9) in such a way that also the piston stays between the valves. When the piston moves towards the valves in front (9) it pushes the combustion gas from the front side of the piston to its back side through a groove (13) located in the surface of the main cylinder. When the combustion gas has moved to the back side of the piston, the explosion takes place and the valve in front of the piston opens. Simultaneously the piston closes the combustion chamber. This is followed by the working phase in which the maximal torque of the piston improves the motor efficiency by about 65% compared to the present Otto-motor.

15 Claims, 5 Drawing Sheets

ROTARY PISTON COMBUSTION ENGINE

The invention relates to a 4-phase combustion engine equipped with a rotary piston, mainly meant to function as a gasoline using engine. The embodiment of the engine consists of a main cylinder body, in which there is a rotating piston rotor comprising a piston attached to a cylindrical body having a fixed shaft in the middle. Thus the shaft functions as the driving shaft of the engine. The engine is operated by two valves, which either open or close the room existing between the engine body and the piston body. The rotation of the piston is achieved when the gas mixture compressed into explosion volume is closed in between both the valves in such a way that also the piston stays in between the valves. When the piston moves towards the valve in front, it pushes the combustion gas from the front side of the piston to its back side through a groove located in the surface of the main cylinder. When the combustion gas has moved to the back side of the piston, the explosion takes place and the valve in front of the piston opens. Simultaneously the piston closes the combustion chamber. This is followed by the working phase in which the maximal torque of the piston around the shaft improves the motor efficiency by about 65% compared to the present Otto-motor. Correspondingly the fuel consumption and pollution gases decrease about 40%.

Practically almost all present car engines are Otto-motors, in which the rotating motion is achieved by means of a crank shaft. However the use of a crank shaft decreases motor efficiency to a great extent. This results from the fact that when the piston is at its top position and the explosion pressure is at its highest, the length of the torque arm is zero and thus the torque of the motor is zero, too. The torque arm reaches its maximum value when the crank shaft has turned almost 90° from its top position. At this stage the explosion pressure has however decreased and is only about ⅕ of the highest pressure. Consequently a great deal of the explosion energy is lost as heat which causes a considerable decrease in motor efficiency.

Nowadays only small quantities of so called Wankel-motors are manufactured. These motors do not have a crank shaft. The operation of the motor is based on the rotation of a triangular piston in an eccentric motion, where the piston pushes the combustion gas forward to a combustion chamber formed by the former piston. In this motor the main defects of a crank shaft have been eliminated, but the eccentric motion has raised new problems: the motors suffer from sealing problems and they break easily. Due to this these motors are currently mainly manufactured for test use.

U.S. Pat. No. 3,692,002 presents a triangular piston structure revolving inside a cylinder. The piston of this motor does not carry out the compression phase, but it is carried out by a compressor outside the motor. Due to the symmetric structure of the motor its torque approaches value zero when the piston approaches the exhaust phase, which decreases the motor efficiency compared to the invention.

U.S. Pat. No. 3,745,979 presents a triangular piston structure, where the pistons move radially inside an elliptical cylinder, where the piston pushes the gas ahead into a storage tank closed by valves. From the storage tank the gas expands to the explosion chamber formed by the former piston. The volume of the explosion chamber increases while combustion gas is led into it. In this structure the pressure in the combustion chamber is smaller than in the storage tank, which decreases the motor efficiency compared to the invention.

Patent publication DE 3926061 A1 presents a motor body and rotor structure similar to the invention but with a different operation. The motor consists of two pairs of pistons, which function by means of eight valves each in turn in such a way that when one pair of pistons is rotating the other one is standing still. According to this functioning principle it is very difficult to construct a functional motor and thus a detailed structure of the motor has not been presented.

According to the invention a so called main cylinder has been made into the engine body and its both ends have been closed by planes forming end walls. Inside the main cylinder there is a revolving piston fastened to a cylindrical piston body, which has a fixed shaft in the middle, which thus functions as a driving shaft of the engine. The engine is operated by two valves. The valves are located in cylinders crossing the main cylinder in such a way that the outer surface of the valves either combines with the cylinder surface of the main cylinder or the valves close the room existing between the engine body and the piston body. The rotating motion of the piston inside the main cylinder is achieved when first the combustion gases compressed into the explosion volume are closed into the room existing between the closed valves in such a way that also the piston remains between the valves. After this the combustion gases are moved from the front side of the piston to its back side through a groove which is wider than the piston in the direction of the cylinder circumference and which is made into the surface of the main cylinder where the explosion chamber is located. While the piston is approaching the valve ahead, it pushes the combustion gases through the groove to the back side of the piston. A little before the piston touches the valve ahead the explosion takes place and the valve opens. At this stage the front edge of the piston has passed over the groove and it touches the surface of the main cylinder thus closing the combustion chamber. This is followed by the working phase of the engine in which the piston revolves in the main cylinder about 290°.

In addition to the former there is a so called pressure adjustment piston in the engine body at the combustion chamber, which can be used for adjustment of pressure variations, caused by the valves and the piston, while they move in the combustion chamber. This is done in such a way that the pressure adjustment piston decreases the combustion volume at least with the same amount and at the same time that the motion of the piston and the valves increase the combustion volume. This prevents the energy loss, which the decrease of explosion pressure would otherwise cause. Due to the rotation of the piston, it creates a torque which is always at the maximum during the whole working phase. Consequently the motor efficiency is about 65% higher than in conventional crank shaft engines. In addition to the former the invention has features, which are presented in patent claim 1.

In the following the accompanying drawings illustrate the invention in detail, in which.

Figure 2:
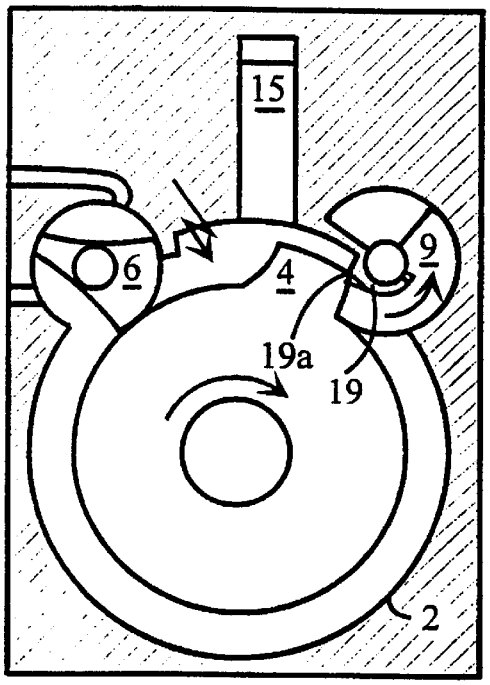
FIG. 2 is a cross-section of the engine at the moment of the explosion
Figure 3:
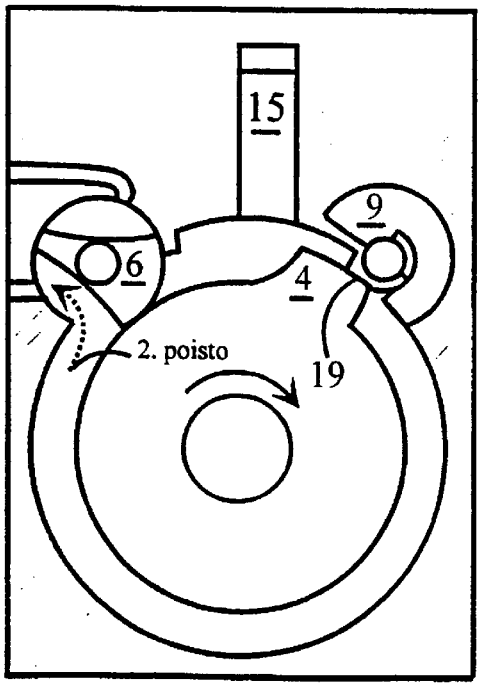
FIG. 3 is a cross-section of the engine a little after the explosion
Figure 4:
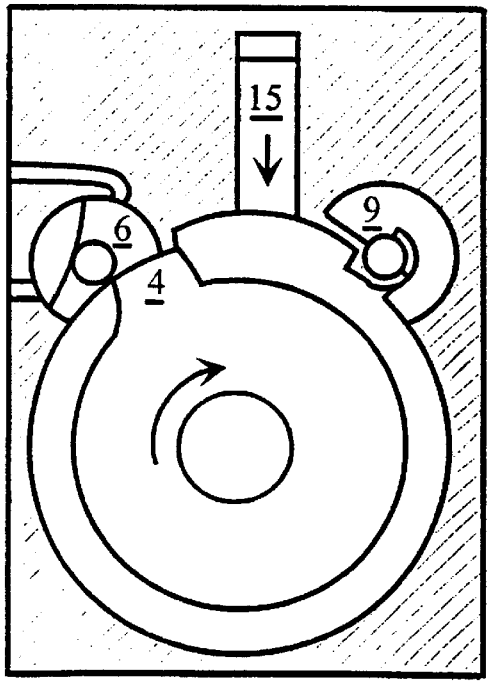
Figure 5:
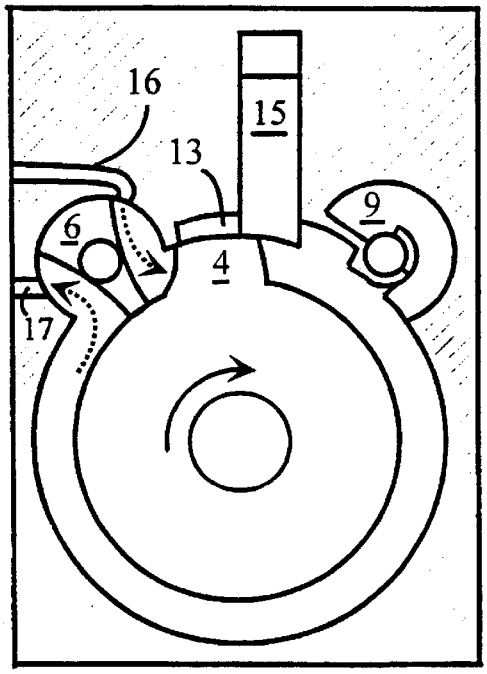
Figure 6:
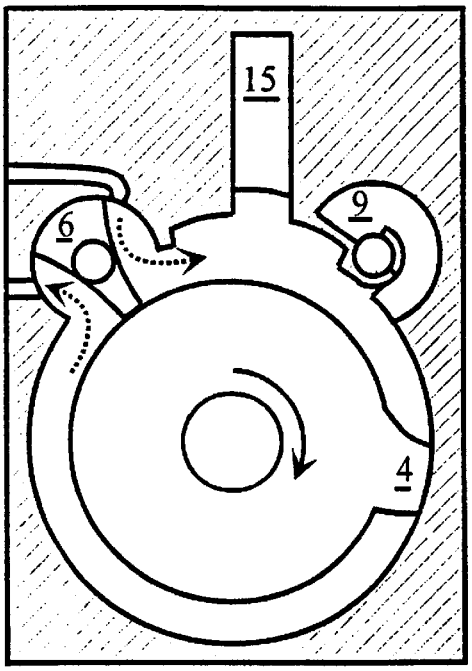
Figure 7:
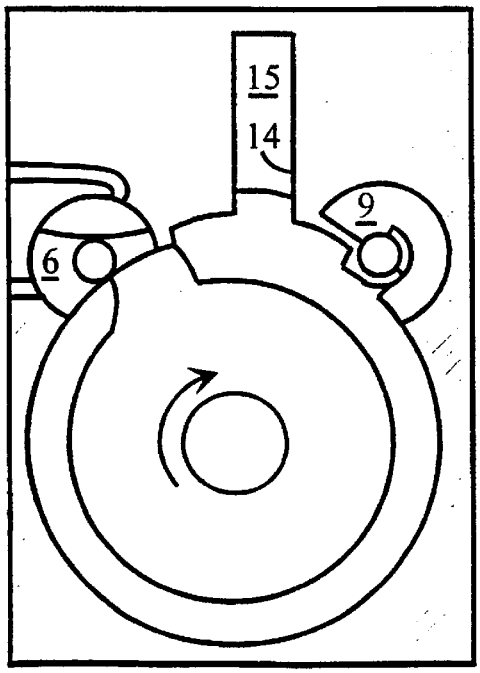
Figure 8:
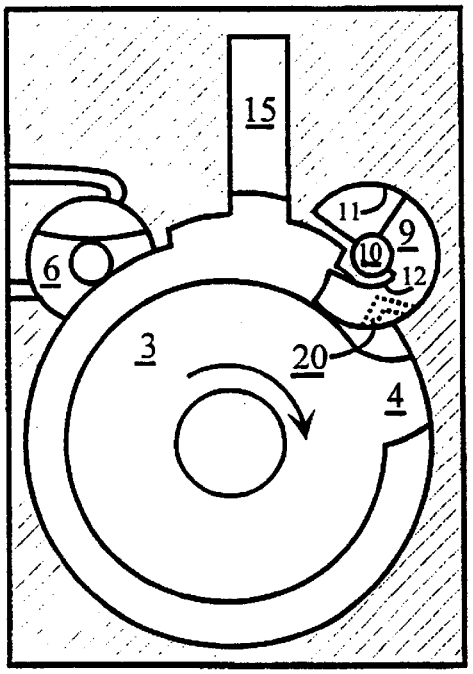
Figure 9:
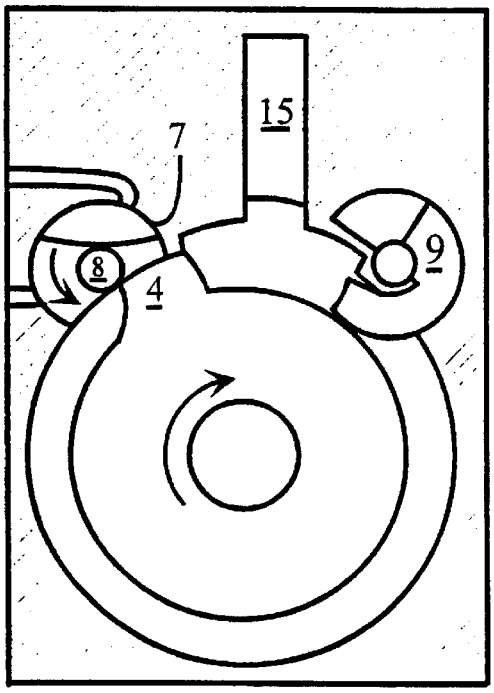
Figure 10:
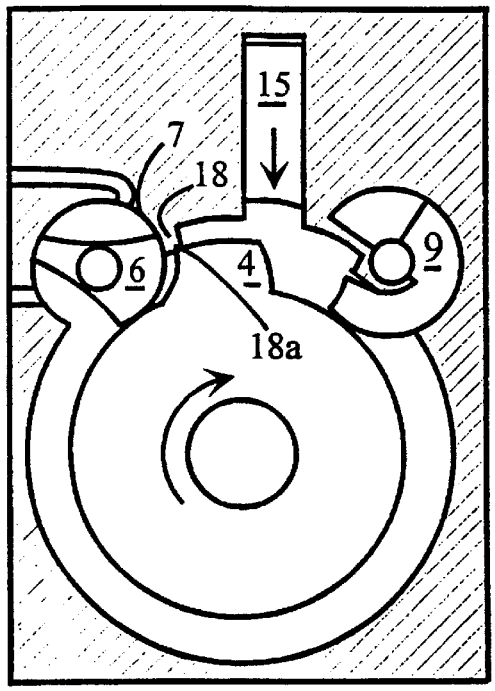
Figure 11:
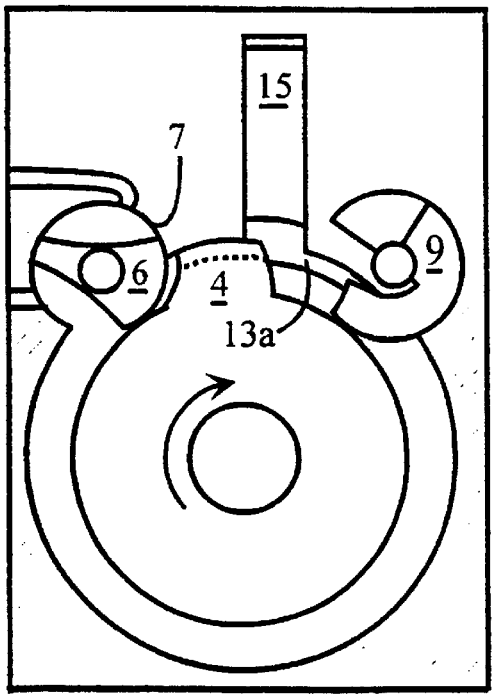
Figure 12:
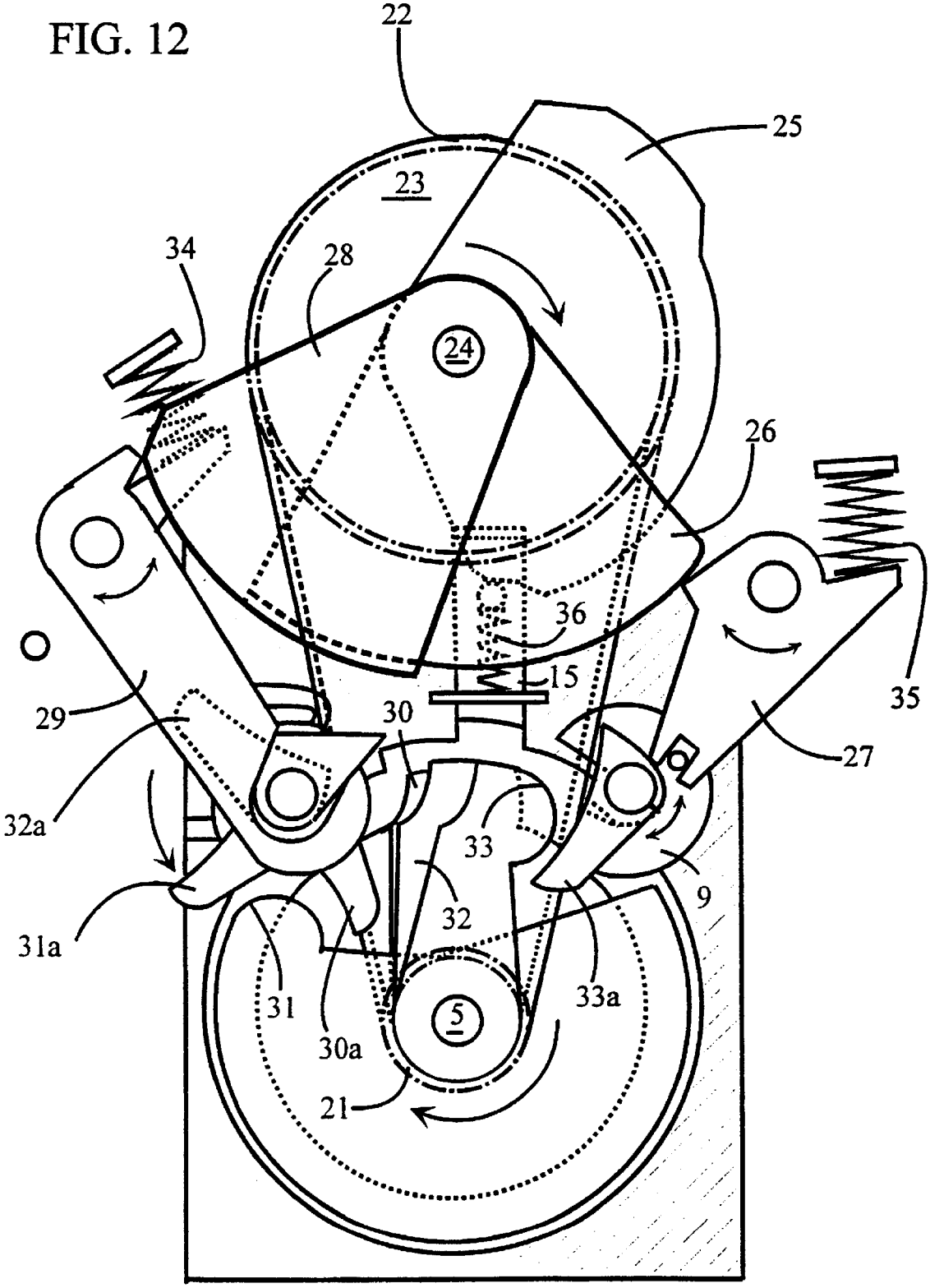
Figure 13:
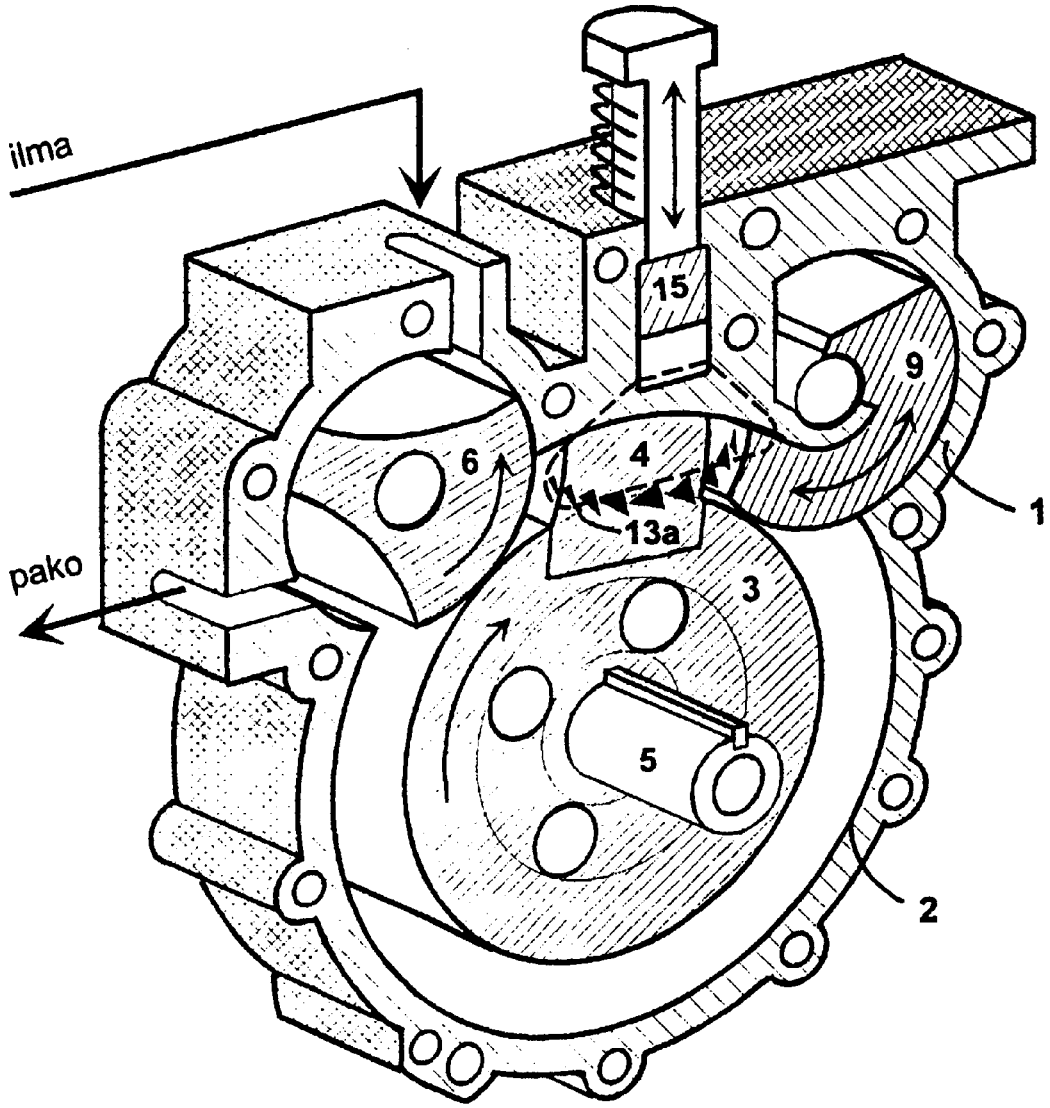

FIG. 4 is a cross-section of the engine a little before the suction-/exhaust phase FIG. 5 is a cross-section of the engine at the beginning of the suction-/exhaust phase FIG. 6 is a cross-section of the engine during the suction-/exhaust phase FIG. 7 is a cross-section of the engine a little before the compression phase FIG. 8 is a cross-section of the engine at the beginning of the compression phase FIG. 9 is a cross-section of the engine a little before the end of the compression phase FIG. 10 is a cross-section of the engine at the end of the compression phase FIG. 11 illustrates a different structure of the engine FIG. 12 illustrates the operation mechanism of the valves and the pressure adjustment piston FIG. 13 illustrates a perspective picture of the cross-section of the engine FIGS. 1–10 illustrate the cross-section of the engine in its different phases of operation. In the figures the following parts of the motor can be seen: The engine body 1, where the main cylinder 2 is located; in the main cylinder the rotating cylindrical piston body 3, onto which the piston 4 is attached; the fixed shaft 5 in the middle of the piston body; the suction-/exhaust valve 6, which rotates in the valve cylinder 7 crossing the main cylinder on the shaft the pressure valve 9, which turns back and forth on the shaft 10 in the valve cylinder 11 crossing the main cylinder in such a way that around the shaft into the engine body has been made a cylinder surface 12 by length about ¼ of a circle, which combines with the inner surface of the pressure valve; into the surface of the main cylinder at the explosion chamber has been made a groove 13 wider than the piston; the pressure adjustment cylinder 14; the pressure adjustment piston 15; the suction channel 16; the exhaust channel 17; the front sealing part 18 in the main cylinder; the back sealing part 19 in the main cylinder and on the cylinder surfaces of the sealing parts the small wedge shaped pressure equalizer grooves 18*a*, 19*a* and the low pressure channel 20 for replacement air.

Figure 1:
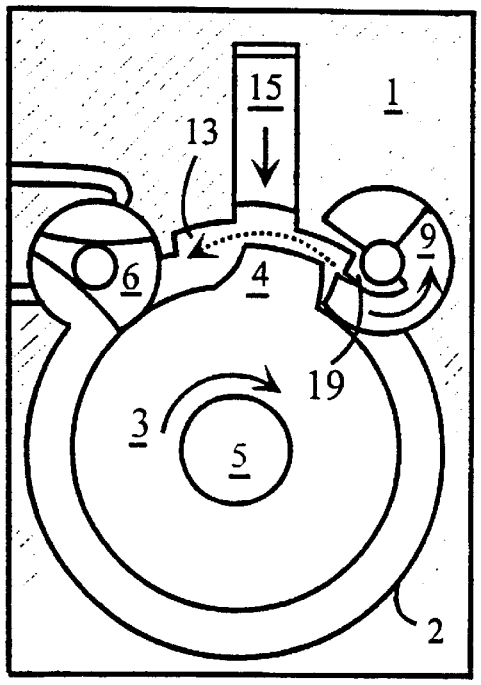
FIG. 1 is a cross-section of the engine a little before the explosion

The engine operates as a 4-phase engine, but only three rounds are needed to carry out these phases, since suction- and exhaust phases take place simultaneously. FIG. 1 demonstrates the engine a little before explosion. At this stage the piston 4 is in the explosion chamber between the valves 6 and 9 in such a way that there exists a small gap between the piston 4 and the pressure valve 9. At this point of the gap the valve 9 starts to open. The purpose of the gap is to give time for the opening of the valve. The gap decreases to zero a little after the front edge of the piston 4 has touched the back sealing part 19 in the main cylinder. At the same moment the rest of the combustion gas has moved to the back side of the piston 4 through the small wedge shaped groove 19*a* in the cylinder surface of the back sealing part 19 and the explosion can take place. This stage is illustrated in FIG. 2. After this the opening speed of the pressure valve 9 is accelerated so that it is a little faster than the circumference speed of the piston 4, until the valve has turned open to the position, where its surface combines with the main cylinder surface 2. This stage is illustrated in FIG. 3. After this the piston 4 passes the pressure valve 9 and continues the working phase about 290° until the engine goes to the following phase.

In the following phase the valve 6 moves to the suction-/exhaust position. The transition stage is illustrated in FIG. 4. In this stage the valve has turned to such a position in which its surface combines with the main cylinder surface 2 and so the piston 4 is able to pass the valve. When the back edge of the piston has passed the middle point of the valve, the valve turns to the beginning of the suction-/exhaust phase, which is illustrated in FIG. 5. In this phase both the suction channel 16 and the exhaust channel 17 are simultaneously open in such a way that the valve at the same time closes the connection between the channels. Due to the former the engine carries out simultaneously both the suction- and the exhaust phases in the way that when the back side of the piston sucks air mixture its front side pushes away the exhaust gases. The suction and exhaust carried out by the piston at the groove 13 have been improved by the pressure adjustment piston 15 in such a way that when the piston 4 approaches the pressure adjustment piston, its lower side comes down to the level of the upper surface of the piston 4. At this stage the pressure adjustment piston and the piston 4 together close the connection between the suction- and exhaust sides at the groove 13. By this arrangement the groove 13 cannot decrease the operation of the suction-/exhaust phase. When the piston 4 has passed the groove 13, the pressure adjustment piston 15 moves back to the position which it had in the beginning. This has been illustrated in FIG. 6 showing the suction-/exhaust phase.

After the suction-/exhaust phase the engine starts the compression phase, which begins in such a way that first the suction-/exhaust valve turns to the position, where the surface of the valve combines with the cylinder surface of the main cylinder 2. In this stage piston 4 passes the valve. This stage is illustrated in FIG. 7. The valve operating mechanism has been designed in such a way that the valve also stays in this position during the whole phase. Next the piston 4 also passes the pressure valve 9, which closes immediately after this. The essential compression phase begins from this stage, where the compression is started by compressing the gas mixture against the pressure valve 9. This has been illustrated in FIG. 8. The pressure valve closes the room between the main cylinder 2 and the piston body 3 in such a way that engine body 1 is partly around the shaft 10 thus forming about ¼ of a cylinder surface in such a way that the inner cylinder surface of the pressure valve combines with the cylinder surface 12 in the body and at the same time the outer surface of the valve touches the cylinder body 3 of the piston. Immediately as the compression phase starts, a low pressure area is created behind the piston. Its creation is prohibited in such a way that a V-shaped replacement air channel 20 is built inside the pressure valve, through which the piston sucks replacement air. During the compression phase later on the replacement air goes out through the exhaust channel during working phase, which is marked in FIG. 3 as: "2. poisto". FIG. 9 illustrates the engine a little before the compression phase ends. In this stage the back edge of the piston has passed the middle point of the suction-/exhaust valve and the valve starts to turn to the position it has during explosion.

FIG. 10 illustrates the engine immediately after the compression phase. A little before the compression phase ends, a small low pressure area is created between the back side of the piston and the valve 6. This low pressure area causes decrease in the motor efficiency, if it has to be filled with the expansion of the already compressed gas mixture. The pressure loss is eliminated, when at the same time that the compressed gas mixture expands into the low pressure area, the pressure adjustment piston 15 decreases the volume with an amount corresponding to the expansion. The even transition of the pressure to the low pressure area is carried out through a wedge shaped groove 18*a* on the sealing part of the cylinder.

When the compression phase has ended, one edge of the suction-/exhaust valve 6 touches the valve cylinder 7 and the other edge touches the piston body 3. By this way the valve forms "a back wall" for the compressed explosion gas. For the continues operation of the engine it is necessary that the explosion gas can be moved from the front side of the piston 4 to its back side. This is carried out through the groove 13, as mentioned before. When the explosion gas has been totally transferred to the pressure side of the piston, it is ignited and the engine repeats all the phases mentioned before.

FIG. 11 illustrates a modification of the engine, in which the groove 13 has been transferred from the main cylinder surface into its side walls. By this procedure the cylinder area of the sealing part 18 in the main cylinder surface can be enlarged which makes a better sealing between the piston and the cylinder surface.

FIG. 12 illustrates the operation mechanism of the valves 6 and 9 and the pressure adjustment piston 13. The following parts can be distinguished in the picture: The driving shaft 5 and fixed to it a tooth wheel 21 connected with a chain 22 to a tooth wheel 23; an auxiliary shaft 24, which is fixed to a cam plate 26, which moves the pressure valve 9 by a valve lever 27; to the auxiliary shaft 24 fixed a cam plate 28, which moves the suction-/exhaust valve 6 by a valve lever 29; in different planes on the driving shaft 5 the suction-/exhaust valve 6 levers 30, 31, 32; the pressure valve 9 lever 33; counterparts 30*a*, 31*a*, 32*a*, 33*a* for the valve levers and the springs 34, 35, 36 for returning the motion.

The engine carries out all the four operation phases during three revolutions, since the suction- and exhaust phases take place simultaneously. Due to this every separate motion of the valve or the pressure adjustment piston takes place only once while the piston rotates three revolutions. Part of these motions can be carried out by the valve levers 30, 31, 32, 33, which are fixed straight to the driving shaft, but part of the motions must be carried out by cam plates 25, 26, 27, since they turn only once during the time that the piston rotates three revolutions. For this reason the driving shaft has a cog wheel 21 with a gear ratio 1:3 to the cog wheel 23 on the auxiliary shaft 24. To the cog wheel 23 has been fixed three cam plates25, 26, 28, the eccentric shape of which controls the operation of the pressure adjustment piston and the valves. The cam plate 25 controls the operation of the pressure adjustment piston 15 in such a way that it decreases the explosion volume during the stage mentioned before and closes the groove 13 during the start of the suction-/exhaust phase. The cam plate 26 closes the pressure valve 9 by the valve lever 27 and keeps it closed up to the explosion phase and then the cam plate releases the valve to open. The cam shaft 28 moves the valve lever 29 in such a way that the valve 6 is transferred from the compression phase to the explosion phase. (pictures 9, 10) The rest of the motions of the valves is achieved by the valve levers attached to the driving shaft 5 of the main cylinder. From these motions the levers 30 and 31 rotate the valve 6 from the working phase to the suction-/exhaust phase by means of the counterparts 30*a*, 31*a*. (pictures 3, 4, 5) The circular construction of the lever 31 also keeps the valve in the position in question during the whole phase. The lever 32 transfers the valve from the former phase to the compression phase by means of the counterpart 32*a*. (pictures 6,7) The lever 33 opens the pressure valve 9 by means of the counterpart 33*a* while the spring 35 accelerates the opening of the valve.

FIG. 13 illustrates a cross-section of the perspective picture of the engine, where the groove 13 in the main cylinder has been totally substituted by the groove 13*a* in the side walls of the engine, through which the explosion gas is transferred from the front side of the piston 4 to its back side, as the arrows show.

In the above the engine has been described as a gasoline engine, but it can also be adapted to run by other fuels correspondingly, like the present Otto-motor. It can also be turned into a Diesel version by adding to it a front chamber.

What is claimed is:

1. A four phase rotary piston combustion engine comprising:

an engine body having a main cylinder, a first valve cylinder, a second valve cylinder and a pressure adjustment cylinder;

a cylindrical piston body rotatably positioned in said main cylinder, said cylindrical piston body having a piston extending radially outward from said body;

a suction-exhaust valve movably mounted in said first valve cylinder;

a pressure valve moveably mounted in said second valve cylinder; and a pressure adjustment piston moveably mounted in said pressure adjustment cylinder, the movement of said pressure adjustment piston functioning to increase and decrease the pressure in the main cylinder during operation of the engine.

2. The engine of claim 1, wherein said main cylinder further comprises a front sealing part and a back sealing part.

3. The engine of claim 2, wherein said front and back sealing parts are positioned between said first and second valve cylinder and define an explosion chamber in said main cylinder.

4. The engine of claim 3, wherein said explosion chamber comprises a groove, said groove being wider than said piston so as to permit transfer of compressed fuel and air around said piston.

5. The engine of claim 2, wherein said front sealing part comprises a pressure equalizing groove.

6. The engine of claim 2, wherein said back sealing part comprises a pressure equalizing groove.

7. The engine of claim 1, wherein said main cylinder further comprises an explosion chamber between said first valve cylinder and said second valve cylinder.

8. The engine of claim 7, wherein said explosion chamber comprises a groove, said groove being wider than said piston so as to permit transfer of compressed fuel and air around said piston.

9. The engine of claim 7, wherein said explosion chamber comprises a groove that permits transfer of compressed fuel and air around said piston.

10. The engine of claim 9, wherein said main cylinder further comprises a sidewall and said groove is defined in said sidewall.

11. The engine of claim 1, wherein said pressure valve comprises a replacement air channel.

12. The engine of claim 1, further comprising a suction channel in communication with said suction-exhaust valve.

13. The engine of claim 1, further comprising an exhaust line in communication with said suction-exhaust valve.

14. A four phase rotary piston combustion engine comprising:

an engine body having a main cylinder, a first valve cylinder, a second valve cylinder and a pressure adjustment cylinder, said main cylinder including a front sealing part and a back sealing part positioned between said first and second valve cylinder and defining a explosion chamber in said main cylinder;

a cylindrical piston body rotatably positioned in said main cylinder, said cylindrical piston body having a piston extending radially outward from said body;

a suction-exhaust valve movably mounted in said first valve cylinder;

a pressure valve moveably mounted in said second valve cylinder; and a pressure adjustment piston moveably mounted in said pressure adjustment cylinder, the movement of said pressure adjustment piston functioning to increase and decrease the pressure in the main cylinder during operation of the engine.

15. A four phase rotary piston combustion engine comprising:

an engine body having a main cylinder, a first valve cylinder, a second valve cylinder and a pressure adjustment cylinder, said main cylinder including a front sealing part and a back sealing part positioned between said first and second valve cylinder and defining a explosion chamber in said main cylinder, said front and back sealing part of said main cylinder each having a pressure equalizing groove and said explosion chamber including a groove that is wider than said piston that permits transfer of compressed fuel-air around said piston;

a cylindrical piston body rotatably positioned in said main cylinder, said cylindrical piston body having a piston extending radially outward from said body;

a suction-exhaust valve moveably mounted secured in said first valve cylinder;

a pressure valve moveably mounted in said second valve cylinder; and a pressure adjustment piston moveably mounted in said pressure adjustment cylinder, the movement of said pressure adjustment piston functioning to increase and decrease the pressure in the main cylinder during operation of the engine.

* * * * *

UNITED STATES PATENT AND TRADEMARK OFFICE

CERTIFICATE OF CORRECTION

PATENT NO. : 6,543,406 B1
DATED : April 8, 2003
INVENTOR(S) : Jukka Kalevi Pohjola It is certified that error appears in the above-identified patent and that said Letters Patent is hereby corrected as shown below:

Title page,
Item [22], delete "Jan. 12, 1999" and insert -- December 1, 1999 --.

Signed and Sealed this

Twenty-third Day of December, 2003

JAMES E. ROGAN
*Director of the United States Patent and Trademark Office*